US006824428B2

(12) United States Patent
Tabata et al.

(10) Patent No.: US 6,824,428 B2
(45) Date of Patent: Nov. 30, 2004

(54) CONNECTOR

(75) Inventors: Masaaki Tabata, Yokkaichi (JP); Keigo Atsumi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/691,380

(22) Filed: Oct. 22, 2003

(65) Prior Publication Data

US 2004/0082219 A1 Apr. 29, 2004

(30) Foreign Application Priority Data

Oct. 24, 2002 (JP) ..... 2002-309399

(51) Int. Cl.[7] ..... H01R 13/40

(52) U.S. Cl. ..... 439/595; 439/752; 439/382

(58) Field of Search ..... 439/752, 752.5, 439/595, 382

(56) References Cited

U.S. PATENT DOCUMENTS

| | | | | | |
|---|---|---|---|---|---|
| 4,124,264 | A | * | 11/1978 | Kato et al. | 439/595 |
| 4,343,523 | A | * | 8/1982 | Cairns et al. | 439/588 |
| 5,554,051 | A | * | 9/1996 | Shinji et al. | 439/595 |
| 5,626,499 | A | * | 5/1997 | Yagi et al. | 439/752.5 |
| 5,788,536 | A | | 8/1998 | Matsuura et al. | |
| 6,280,250 | B1 | * | 8/2001 | Ko | 439/595 |

* cited by examiner

*Primary Examiner*—Tho D. Ta
(74) *Attorney, Agent, or Firm*—Gerald E. Hespos; Anthony J. Casella

(57) ABSTRACT

A connector has a housing (11) with a cavity (12) for receiving a rectangular tube (Ta) of a terminal fitting (T). A lock (13) is formed on a surface of the cavity (12) for engaging the terminal fitting (T). The cavity (11) has a first guiding surface (14*a*) at a corner adjacent a surface of the cavity (12) opposed to the lock (13) for narrowing the width of a cavity (12). A retainer (21) engages a lower surface of the lock (13) for pressing the lock (13) and the terminal fitting (T) up into the first guiding surface (14*a*) to prevent shaking of the terminal fitting (T) in the cavity (12).

14 Claims, 4 Drawing Sheets

CONNECTOR

BACKGROUND OF THE INVENTION

1. Field of the Invention

The invention relates to a connector designed to prevent a terminal fitting from shaking in a cavity.

2. Description of the Related Art

A connector includes a housing with opposite front and rear ends and at least one cavity extending through the housing from the rear end to the front end. A resilient lock is formed on the lower surface of the housing and is cantilevered into the cavity. A terminal fitting is inserted into the cavity from behind and is locked by the lock. A small clearance is defined between the cavity and the terminal fitting. A large clearance may cause the terminal fitting to shake in the cavity even when connected with a terminal fitting of a mating connector. The connected terminal fittings may be abraded at their points of contact due a shaking action over a long term, especially in high vibration environments, such as in an automotive vehicle. Such abrasion can cause various troubles.

U.S. Pat. No. 5,788,536 and FIG. 4 herein show a connector intended to prevent a terminal fitting from shaking in a cavity. As shown in FIG. 4, this connector has a housing 1 formed with a cavity 2. Elongated projections 3 project in on four inner walls of the cavity 2 along an inserting direction of a terminal fitting. Thus, there is no significant clearance between the cavity 2 and the terminal fitting at points where the respective elongated projections 3 are formed. As a result that the terminal fitting is prevented from shaking in lateral and vertical directions in a plane perpendicular to the inserting direction of the terminal fitting.

The elongated projections 3 prevent the terminal fitting from shaking in the cavity 2. However, a larger inserting force is required to insert the terminal fitting into the cavity due to the contact with the elongated projections 3. Further, the elongated projections 3 cannot prevent the terminal fitting from shaking in forward and backward directions. The contact points of the terminal fitting are subject to abrasion if the terminal fitting shakes in forward and backward directions due to vibration of the connector itself or due to a vibration exerted on the terminal fitting by the shake of a wire.

The invention was developed in view of the above problem and an object thereof is to provide a connector that can prevent a terminal fitting from shaking in a cavity while preventing a large inserting force to insert the terminal.

SUMMARY OF THE INVENTION

The invention is directed to a connector with a housing that has at least one cavity extending therethrough. A resiliently deformable lock is provided at a first surface of the cavity. At least one terminal fitting is inserted into the cavity of the housing and is locked by the lock so as not to come out. The terminal fitting includes a tube. A retainer is insertable into a deformation permitting space for the lock to prevent deformation of the lock. An area of the cavity for accommodating the tube has a cross section that substantially conforms to the tube so that the tube can be inserted with a low insertion force. A first guiding surface narrows the width of the cavity toward a second surface of the cavity substantially opposed to the first surface of the cavity and opposed to the lock. The first guiding surface is at least at one of the corners of the second surface of the cavity and extends forward and back parallel to the insertion direction of the terminal fitting. The tube of the terminal fitting is pressed against the first guiding surface by displacing the lock towards the terminal fitting when the retainer is mounted to prevent the terminal fitting from shaking laterally and/or vertically. Accordingly, the connector maintains a low insertion force for the terminal fitting and prevents the terminal fitting from shaking.

A guiding section preferably is provided on the lock for displacing the lock towards the terminal fitting during the insertion of the retainer.

The retainer preferably is mountable through the front of the housing.

The terminal fitting is not pressed against the first guiding surface until the retainer is mounted. Thus, an inserting force is low as the terminal fitting is inserted. The retainer is inserted to a specified position after the terminal fitting is inserted completely into the cavity. The retainer displaces the lock in towards the terminal fitting. Accordingly, the terminal fitting is displaced toward the upper surface of the cavity and is pressed against the first guiding surface. Thus, the terminal fitting cannot shake in the cavity.

A recess preferably is formed in the second surface of a front area of the cavity for receiving the tube of the cavity.

A second guiding surface preferably is provided at least at one of corner of the recess. The second guiding surface extends in a widthwise direction at the front and/or rear sides of the recess and narrows a dimension of the recess in forward and backward directions at locations toward the second surface of the recess.

The tube of the terminal fitting is pressed against the second guiding surface by displacing the lock towards the terminal fitting when the retainer is mounted. Thus, the terminal fitting cannot shake forward and backward, even if a vibration is exerted on the terminal fitting while the terminal fitting is connected with the mating terminal fitting. Thus, there is no possibility of abrading the terminal fittings at their points of contact.

The first and second guiding surfaces preferably are provided on facing corners. Thus, the terminal fitting is brought into contact with the first and second guiding surfaces at both facing corners when pressed in towards the terminal fitting by the retainer and is centered.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1A:
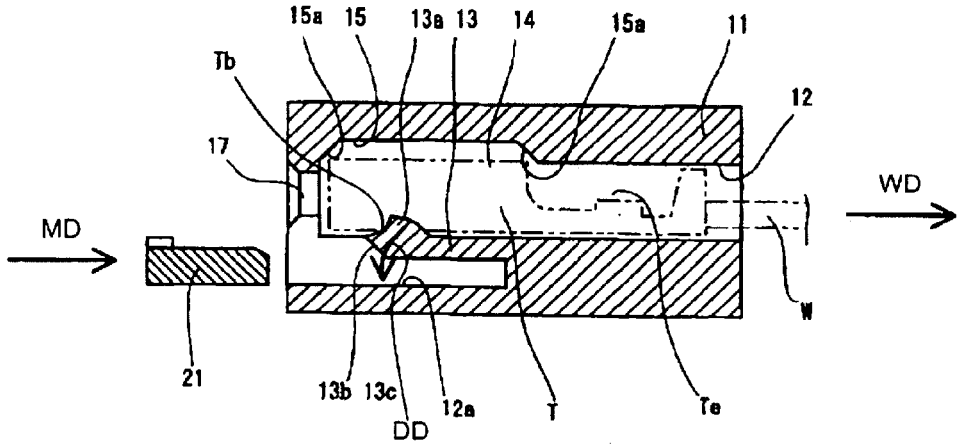
FIGS. 1(A) and 1(B) are an exploded longitudinal sectional view and a lateral sectional view of a connector according to one embodiment of the invention.
Figure 1B:
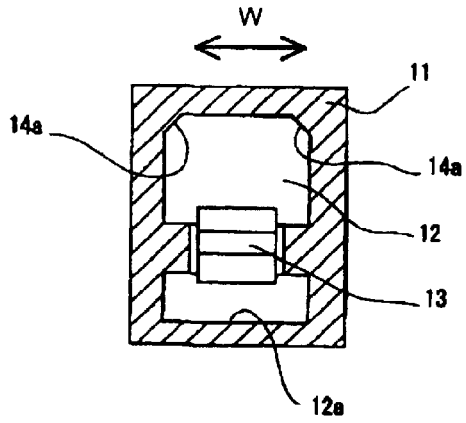

A connector according to the invention is identified by the numeral 10 in FIGS. 1(A) and 1(B). The connector 10 has a housing 11 formed e.g. of a synthetic resin, and cavities 12 extend through the housing 11 in forward and backward directions. In this regard, the front of the housing 11 is the end connected to a mating housing. A lock 13 is cantilevered forwardly and inwardly from the bottom surface of the cavity 12, and a locking section 13*a* is formed on the upper surface of the leading end of the lock 13. Each cavity 12 has a tab insertion opening 17 that opens at the front of the housing 10 for receiving a male tab (not shown) of a mating connector.

Terminal fittings T are inserted into the cavities 12 from the rear. Each terminal fitting T is a female terminal fitting with a substantially rectangular tube Ta at the front end, and wire-connecting portion Te at its rear end. The wire-connecting portion Te is configured for crimped, bent, folded or soldered connection with a wire W. A locking hole Tb is formed in the bottom surface of the rectangular tube Ta and is engageable with the locking section 13*a* at the corresponding upper surface of the leading end of the lock 13 to restrict movement of the terminal fitting T in a withdrawing direction WD. The lock 13 is deformed resiliently down in a deformation permitting direction DD during the insertion of the terminal fitting T and retracts into a deformation permitting space 12*a* below the lock 13.

A retainer 21 is mounted into the housing 11 from the front and along a mounting direction MD, which is substantially parallel to an insertion and withdrawal direction of the terminal fitting T. The mounted retainer 21 enters the deformation permitting space 12*a* to restrict deformation of the lock 13 into the deformation permitting spaces 12*a*. A guide 13*b* projects down from the lower surface of the lock 13 toward the deformation permitting space 12*a* to reach an area where the retainer 21 is to be inserted. A slanted surface 13*c* is formed at the leading end of the guide 13*b* to interfere with the retainer 21 during the insertion of the retainer 21 into the deformation permitting spaces 12*a*. Thus, the retainer 21 forcibly displaces the locks 13 up in a direction substantially opposite the deformation direction DD and towards the terminal fitting T in the cavity 12.

A front area 14 of the cavity 12 has a substantially rectangular cross section whose width and height are slightly larger than those of the rectangular tube Ta of the terminal fitting T. Opposite corners of the upper surface of each cavity 12 are chamfered to define first guiding surfaces 14*a* that extend forward and back and face the locking section 13*a* of the lock 13. The first guiding surfaces 14*a* narrow the upper part of the cavity 12 in areas opposed to the lock 13. Thus, opposite upper corners Tc of the rectangular tube Ta contact the first guiding surfaces 14*a* to prevent the terminal fitting T from shaking laterally when the terminal fitting T is pressed up.

A recess 15 is formed in the upper surface of the front area 14 of each cavity 12 and is dimensioned to receive the rectangular tube Ta. Front and rear ends of the recess 15 have chamfered corners that extend in a widthwise direction W to define second guiding surfaces 15*a* that narrow the length of the recess 15 toward its upper surface. Thus, front and rear corners Td at the upper surface of the rectangular tube Ta contact the second guiding surfaces 5*a* when the terminal fitting T is pressed up to prevent the terminal fitting T from shaking in forward and backward directions.

Figure 2A:
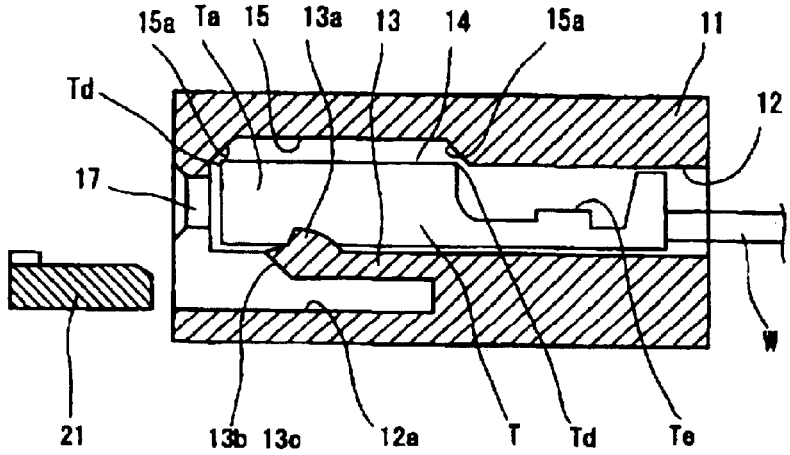
FIGS. 2(A) and 2(B) are a longitudinal section and a lateral section showing a state where a terminal fitting is inserted into a housing.
Figure 2B:
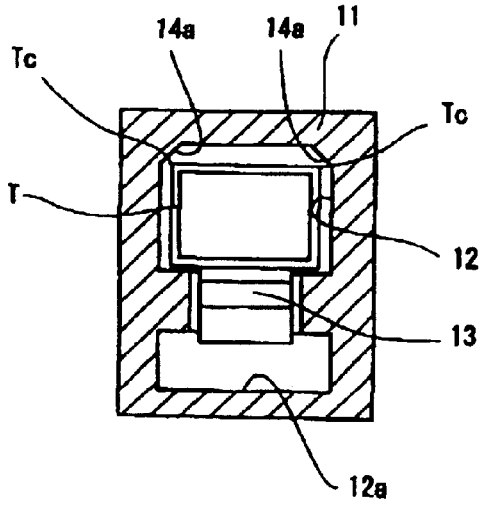

Each terminal fitting T is inserted into the corresponding cavity 12 from behind in a direction opposite the withdrawal direction WD, as shown in FIGS. 2(A) and 2(B). The rectangular tube Ta presses the lock 13 as the terminal fitting T is inserted, and hence the lock 13 is deformed resiliently in the deformation direction DD and into the deformation permitting space 12*a*. The lock 13 is restored resiliently towards its original shape when the terminal fitting T is inserted to a specified position. Thus, the locking section 13*a* engages the locking hole Tb to lock the terminal fitting T so as not to come out. A small clearance is defined between the rectangular tube Ta and the cavity 12 at the time of inserting the terminal fitting T. Therefore, insertion resistance of the terminal fitting T is very small, and is sufficient only to deform the lock 13. At this point, the rectangular tube Ta of the terminal fitting T is slightly movable in the cavity 12 in lateral, vertical and/or forward and backward directions.

Figure 3A:
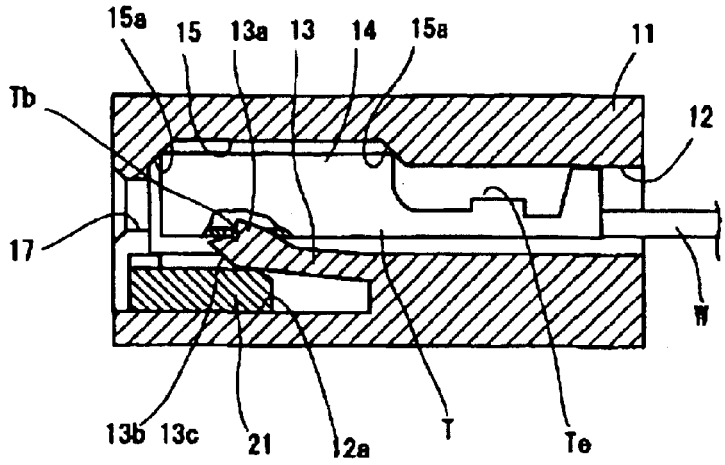
FIGS. 3(A) and 3(B) are a longitudinal sectional view and a lateral sectional view of the connector with a retainer mounted.
Figure 3B:
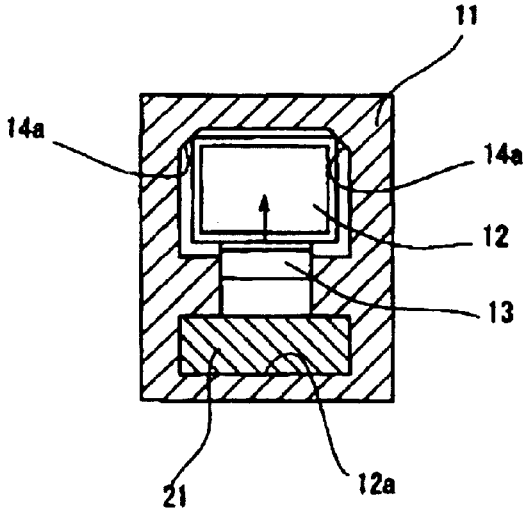
Figure 4:
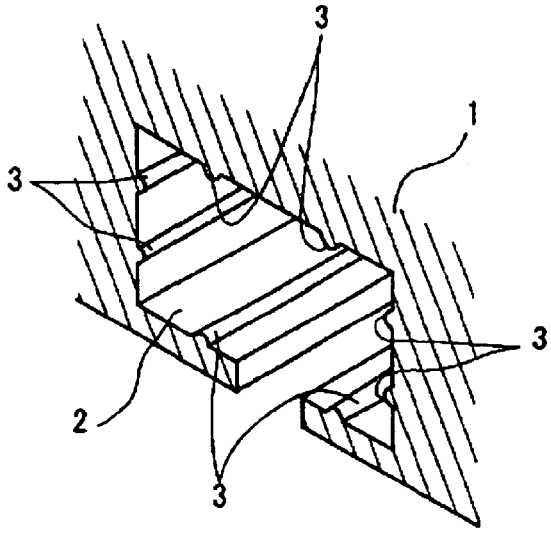
FIG. 4 PRIOR ART
FIG. 4 is a perspective view of a prior art housing.

The retainer 21 then is inserted into the deformation permitting spaces 12*a* from the front and along the mounting direction MD, as shown in FIGS. 3(A) and 3(B). Thus, the retainer 21 is located along the lower surfaces of the locks 13 and restricts the locks 13 from being displaced in the deflection direction DD toward the deformation permitting spaces 12*a*. As a result, the terminal fittings T are locked securely by the locks 13. Insertion of the retainer 21 generates interference with under the locking portions 13 or in the deflection direction DD with the guiding sections 13*b* of the locks 13 and presses the locks 13 up in a direction substantially opposite to the deflection direction DD. As a result, the locks 13 are pressed up in the cavities 12 in a direction substantially opposite to the deflection direction DD. As a result, the opposite side corners Tc of the rectangular tubes Ta are pressed against the opposite first guiding surfaces 14*a*. Accordingly, the rectangular tubes Ta are prevented from shaking in lateral and/or vertical directions. Simultaneously, the front and rear corners Td of the rectangular tubes Ta are pressed against the second guiding surfaces 15*a* at the front and rear ends of the recesses 15. Therefore the rectangular tubes Ta cannot shake in forward, backward and/or vertical directions. In this way, the locks 13 are pressed up in a direction opposite the deflection direction DD as the retainer 21 is inserted and prevent the terminal fitting T from shaking in all directions.

Although the female terminal fitting is illustrated in the foregoing embodiment, the invention is applicable to a tube of a male terminal fitting. Further, the first guiding surfaces 14*a* are at the opposite sides and the second guiding surfaces 15*a* are at opposite ends. However, the first and second guiding surfaces 14*a* and 15*a* may be provided at only one side or one end respectively. However, they preferably are provided in opposed pairs to center the terminal fitting T laterally and/or longitudinally. Further, the terminal fitting T is prevented from shaking laterally by the first guiding surfaces 14*a* and longitudinally by the second guiding surfaces 15*a*. However, the shake of the terminal fitting may be prevented only by the first guiding surfaces 14*a*.

Further, although a nonwatertight connector is illustrated in the foregoing embodiment, the present invention is applicable to a watertight connector provided with a sealing plug.

As is clear from the above description, the terminal fitting is prevented from shaking laterally and/or vertically by sliding the retainer against the guiding section of the lock to press the lock and the terminal fitting up in a direction opposite to the deflection direction DD of the lock. The tube is not pressed against the first guiding surface of the cavity when the terminal fitting is inserted into the cavity. Thus, insertion resistance during the insertion of the terminal fitting is not excessive, and the insertion efficiency is improved. Further, the second guiding surfaces can be provided in the cavity at positions spaced along forward and backward directions to prevent longitudinal shaking of the terminal fitting.

Thus, damages caused by friction with the mating terminal fittings resulting from the shake of the terminal fittings can be prevented, and reliability in using the connector over a long term can be secured.

What is claimed is:

1. A connector with a housing having opposite front and rear ends, at least one tab insertion opening extending rearwardly into the front end and at least one cavity extending forwardly into the rear end and communicating with the tab insertion opening, the cavity being cross-sectionally larger than the tab insertion opening, a resiliently deformable lock provided at a first surface of the cavity and being resiliently deformable into a deformation permitting space, at least one terminal fitting with a tube insertable into the cavity from the rear end and along an insertion direction, the terminal fitting being configured to deflect the lock into the deformation permitting space during insertion and to be engaged by the lock after complete insertion of the terminal fitting in the cavity, and a retainer mountable to the housing and insertable into a deformation permitting space for preventing resilient deformation of the lock, wherein:

an area of the cavity for accommodating the tube has a cross section substantially conforming with the tube, a first chamfered guiding surface at least at one corner of a second surface of the cavity substantially opposite to the first surface of the cavity and substantially opposite to the lock for narrowing the cavity in directions transverse to the insertion direction, the tube of the terminal fitting being pressable against the first chamfered guiding surface by displacing the lock towards the terminal fitting when the retainer is mounted, thereby preventing the terminal fitting from shaking in lateral and/or vertical directions.

2. The connector of claim 1, wherein a guiding section is formed on the lock for forcibly displacing the lock towards the terminal fitting upon the insertion of the retainer.

3. The connector of claim 1, wherein the second surface faces a locking section of the lock that engages the terminal fitting.

4. The connector of claim 1, wherein the retainer is mountable to a front surface of the housing.

5. The connector of claim 1, wherein the second surface of the cavity has a recess for receiving the tube.

6. The connector of claim 5, further comprising a second chamfered guiding surface for shortening the cavity in directions parallel to the insertion direction at locations adjacent the second chamfered surface of the cavity.

7. The connector of claim 6, wherein the tube is pressable against the second chamfered guiding surface by displacing the lock towards the terminal fitting when the retainer is mounted, thereby preventing the terminal fitting from shaking parallel to the insertion direction.

8. The connector of claim 6, wherein the first chamfered guiding surface and the second chamfered guiding surface are provided on facing corners of the second surface.

9. A connector with a housing having opposite front and rear ends and at least one cavity extending in a longitudinal direction between the front and rear ends, the cavity having opposed first and second surfaces extending substantially parallel to the longitudinal direction, a resiliently deformable lock provided on the first surface of the cavity the second surface having at least one chamfered longitudinal corner extending along the longitudinal direction of the cavity at locations spaced rearwardly from the front end of the housing for narrowing the cavity at locations adjacent the second surface and in a width direction transverse to the longitudinal direction, the at least one chamfered longitudinal corner being disposed so that the resiliently deformable lock is opposed to the at least one chamfered longitudinal corner.

10. The connector of claim 9, wherein the at least one chamfered longitudinal corner comprises two opposed chamfered longitudinal corners.

11. The connector of claim 10, wherein the second surface further has at least one chamfered transverse corner extending along the width direction of the cavity for shortening the cavity at locations adjacent the second surface and in the longitudinal direction.

12. The connector of claim 10, further comprising a deformation permitting space adjacent the resiliently deformable lock for accommodating deformation of the lock away from the second surface and a retainer insertable into the deformation permitting space for urging the lock towards the second surface.

13. The connector of claim 12, further comprising a terminal fitting insertable into the cavity and configured to be locked by the lock, the terminal fitting having a rectangular tube dimensioned to be urged into the chamfered longitudinal corners when the retainer is inserted into the deformation permitting space for preventing shaking of the terminal fitting in the cavity.

14. A connector with a housing having opposite front and rear ends and at least one cavity extending in a longitudinal direction between the front end and rear ends, the cavity having opposed first and second surfaces substantially parallel to the longitudinal direction, a resiliently deformable lock provided on the first surface of the cavity, the second surface having two opposed chamfered longitudinal corners extending along the longitudinal direction of the cavity for narrowing the cavity at locations adjacent the second surface and in a width direction transverse to the longitudinal direction, the second surface further having at least one chamfered transverse corner extending along the width direction of the cavity for shortening the cavity at locations adjacent the second surface and in the longitudinal direction.

* * * * *